United States Patent [19]

Miki et al.

[11] Patent Number: 4,523,874

[45] Date of Patent: Jun. 18, 1985

[54] PLASTIC UNDERDRAINAGE TUBE

[75] Inventors: Shinji Miki; Toyokazu Nishio; Shinzo Matsuyama; Shinichi Yamazaki, all of Azuchimachi, Japan

[73] Assignee: Takiron Co., Ltd., Osaka, Japan

[21] Appl. No.: 422,088

[22] Filed: Sep. 23, 1982

[51] Int. Cl.[3] ..... E02B 11/00

[52] U.S. Cl. ..... 405/43; 405/45

[58] Field of Search ..... 405/43, 45, 48, 50, 405/49; 138/123, 125, 140, 141

[56] References Cited

U.S. PATENT DOCUMENTS

| | | | |
|---|---|---|---|
| 3,946,762 | 3/1976 | Green | 405/45 |
| 4,140,422 | 2/1979 | Crumpler, Jr. et al. | 405/49 |
| 4,182,582 | 1/1980 | Youval et al. | 405/45 |
| 4,183,696 | 1/1980 | Auriemma | 405/43 |
| 4,235,561 | 11/1980 | Peterson | 405/45 |
| 4,288,321 | 9/1981 | Beane | 405/45 X |

FOREIGN PATENT DOCUMENTS

| | | | |
|---|---|---|---|
| 703595 | 2/1954 | United Kingdom | 405/45 |

*Primary Examiner*—David H. Corbin
*Attorney, Agent, or Firm*—Armstrong, Nikaido, Marmelstein & Kubovcik

[57] ABSTRACT

A plastic underdrainage tube of generally reticular configuration formed by integrally extruding a plastic material is disclosed. The tube is basically composed of axially spaced apart annular bands having relatively greater thicknesses to reinforce or impart to the tube a high stability against surrounding pressures, and circumferentially disposed longitudinal strands in thicknesses less than those of said annular bands. These longitudinal strands are closely spaced apart along the circumference of the tube to form drainage openings between the circumferentially adjacent strands, the openings being disposed across the entire periphery and lengthwise of the tube to allow the water inflow over the entire wall portion thereof. Each of said strands is blended into or integrally joined at its intersections to the annular bands so as to be mechanically supported by said annular bands of reinforcing members, thus improving the overall strength of the tube to withstand the surrounding pressure while maintaining the amount of plastic material to be used at a low level. In another version, longitudinal strands are formed in sinuously corrugated configuration and blend at their valley portions into the annular bands to define the drainage openings between the ridge portions of the adjacent strands. The external forces acting on the ridge portions can be spreaded or decentralized by the corrugation of the strands and supported by the adjacent annular bands of reinforcing member.

3 Claims, 7 Drawing Figures

PLASTIC UNDERDRAINAGE TUBE

BACKGROUND OF THE INVENTION

1. Fields of the Invention

This invention relates to plastic underdrainage tube of the type buried along the soil to remove excess ground water from the soil, more particularly to a plastic underdrainage tube of generally reticular configuration in which longitudinal strands are closely spaced apart to define the drainage openings therebetween.

2. Description of the Prior Art

Underdrainage tubes, being subject to a high pressure or force by the surrounding soil, will require a high mechanical strength of withstanding such pressures. For this reason, conventional plastic underdrainage tubes, as illustrated in FIG. 1, have been thick-wall ones with a large number of minute pores 9 through the wall 8 thereof. However, such thick-wall type plastic tubes are almost disadvantageous from economic and resource-saving standpoints, in view of much material required to manufacture, Furthermore, due to the fact that excess numbers of the pores will weaken the tube strength against the surrounding pressures, the tube should be made to have a limited number of pores or opening ratio. Accordingly, the plastic tubes of higher drainage capacity have been difficult to be obtained.

SUMMARY OF THE INVENTION

The drawbacks and disadvantages of the above prior plastic underdrainage tubes are obviated by the present invention which has for an object the provision of a novel plastic underdrainage tube which, in spite of less amount of the plastic material being required to manufacture, exhibits a higher stability or sufficient mechanical strength to withstand the surrounding pressures while at the same time provides a higher drainage capacity. In accordance with the present invention, there are disclosed plastic tubes characterized by a plurality of longitudinal strands having relatively smaller thicknesses and a plurality of annular bands in thicknesses greater than those of the strands, the longitudinal strands being closely spaced apart in circumferentially arrangement to define therebetween the drainage openings which are small enough to block the entry of gravels or pebbles in the surrounding soil, and the annular bands blending into or incorporating with each of the longitudinal strands at their intersections to support or receive the external forces acting on the longitudinal strands from the surroundings so as to render the tube strong enough to withstand such forces without being bent or buckled. In the preferred embodiments of the present invention, there are disclosed two basic types of plastic underdrainage tube of unique configuration. One is characterized in that each of longitudinal relatively thin strands is sinuously corrugated and blends at its ridge portions into outer peripheries of the relatively thick annular bands to form the drainage openings between the valley portions of the adjacent strands and that longitudinal bars having thicknesses greater than those of the strands are incorporated into the annular bands at its intersections. With this configuration, the longitudinal bars of thick elements, together with the annular bands of also thick elements makes generally rectangular lattices to strengthen the whole tube and particularly to reinforce the valley portions formed in the corrugated wall of the tube, therefore the tube thus constructed can be prevented from being bent or buckled at these valley portions. The other is characterized in that each of longitudinal strands is sinuously corrugated and blends at its valley portions into the outer peripheries of the annular bands so as to form the drainage openings between the ridge portions of the adjacent strands. With this configuration, the external forces acting on the ridge portions of the longitudinal strands of thin elements will be supported by the annular bands of thick elements to assure enough strength against bending or buckling.

The present invention also discloses further advantageous configuration of the plastic underdrainage tube in which a thin plastic film covers the inner surface in the lower circumferential half of the reticular tube so as to flow the water in the tube without being disturbed by the inwardly protruding bands and strands, increasing flow efficiency of the water running in the tube. Accordingly, further object of the present invention is to provide a plastic underdrainage tube that is capable of flowing smoothly the water in the tube to enhance drainage capacity.

Another object of the present invention is to provide a plastic underdrainage tube of the type which is easily formed to shape using smaller amounts of plastic material and overall lower production cost.

Still further advantages and characteristics of the invention are depicted in the claims and the following detailed description, explaining preferred embodiments by way of example only.

DETAILED DESCRIPTION OF THE PREFERRED EMBODIMENTS

Figure 1:
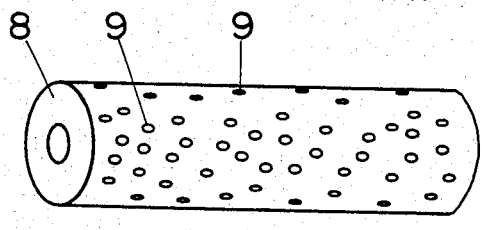
Fig. 1 PRIOR ART
FIG. 1 is a schematic illustration of a prior plastic underdrainage tube.
Figure 2:
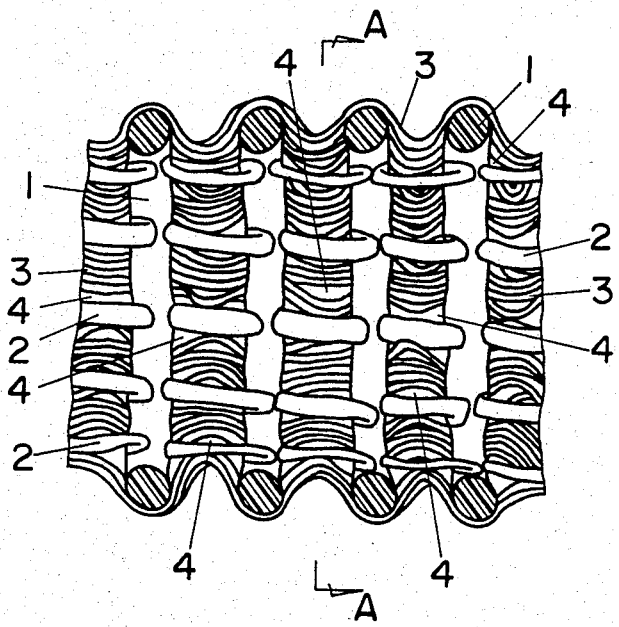
FIG. 2 is a longitudinal section of the plastic underdrainage tube with an inner plastic film removed in accordance with a preferred embodiment of the present invention.
Figure 3:
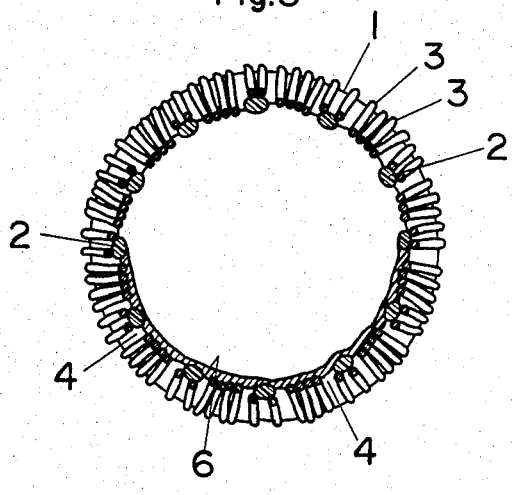
FIG. 3 is a transverse section taken along the line A—A in FIG. 2.

Referring now to FIGS. 2 and 3, there is illustrated one preferred embodiment of a plastic underdrainage tube of generally reticular construction consisting basically of a plurality of annular plastic bands 1 having relatively greater thicknesses, a plurality of longitudinal plastic bars 2 having relatively greater thicknesses and a plurality of longitudinal plastic strands 3 in thicknesses less than those of each of the bands 1 and bars 2. The plastic material employed may be any thermoplastic ones, for example, high density solid polyethylene or foamed polyethylene (the density of a foam is of the order of two-thirds to one-fifth, preferably of the order of one-half to one-third that of the solid one).

The tube is formed by a continuous extruding method which employs two coaxially disposed die members one of which is held stationary and the other is reciprocated in axial direction to separate the contacting surfaces between two die members. In this method, a plurality of said longitudinal bars 2 and strands 3 are continuously extruded through the openings of different diameters which are circumferentially spaced along the contacting surfaces, while a plurality of said annular bands 1 are extruded through the gap formed between the contacting surfaces of two die members when separated to intersect with or join integrally the above bars 2 and strands 3 at right angles to form a generally reticular structure.

Each extruded annular band 1 is generally elliptical in longitudinal cross section with its major axis extending rather radially, as shown in FIG. 2. Into each annular band 1 are merged said longitudinal bars 2 at substantially regular distances along the circumference thereof to provide substantially parallel relationship therebetween. Also the longitudinal bar 2 has a generally elliptical cross section with its major axis extending in circumferential direction of the resulting tube. Each annular band 1 is extruded to have a greater minor axis than that of the longitudinal bars 2, which in turn have a greater minor axis than the diameter of each longitudinal strand 3. For tubes 10 to 15 cm in diameters, for example, the major axis (which can be regarded as the thickness) or the diameter of the band 1, the bar 2 and the strand 3 are set to be of the orders of 0.7 to 2.0, 0.3 to 1.0 and 0.1 to 0.5 cm respectively, the annular bands 1 being evenly spaced apart at a distance of 0.5 to 2.0 cm in longitudinal direction, three to twelve longitudinal bars 2 being disposed in evenly spaced apart relationship along the inner periphery of the bands 1, and 50 to 150 longitudinal strands 3 being disposed along the outer periphery of the bands 1.

Each longitudinal bar 2 is extruded in lengthwise direction with its partial portions folded back at the intersections with the annular bands 1 to form a longitudinally extended element parallel to the longitudinal axis. The longitudinal strands 3 are extruded in circumferentially closely spaced apart relationship and join integrally the outer periphery of the annular bands 1 at their intersections to define therebetween drainage openings 4 which are sized to allow the water flow from the surrounding soil into the inside of the tube while blocking the entrance of the gravels or pebbles from the soil. The openings 4 thus formed are generally in the form of rather longitudinally elongated slots having widths less than that of the longitudinal bar 2 with possible exceptions. As illustrated in FIG. 2, each longitudinal strand 3 is sinuously corrugated and intersect with or blends into the anuular bands 1 at their ridge portions to define said openings between some valley portions of the adjacent strands 3. These strands 3 of corrugated configuration are formed by loosening the tension forces applied on the extruded strands 3 on its longitudinal direction in the course of drawing them from the die members. Thus corrugated strands 3, due to the residual plasticity, suffer at some segments thereof circumferential staggers to join or interlace with each other, with the result that in some regions the adjacently disposed strands 3 compact and make mechanical connections therebetween so as to reinforce the valley portions, while at the same time leaving in other regions said openings 4 defined by the circumferentially closely spaced apart adjacent strands 1. Such openings 4 occur mainly at the positions adjacent to the longitudinal bars 2, therefore they are disposed at substantially regular distances in the circumferential direction as well as in the longitudinal direction.

On the other hand, the longitudinal strands parallel to each other and to the longitudinal axis may be applied in the present invention, provided that the strands are circumferentially spaced apart closely enough to allow the formation of the openings of the like dimensions as above. Such parallel strands are obtained by drawing the same at a speed equal to the extruding speed, in contrast to the above-described procedure. In this case, there are possible staggers in the strands as occurs in the above corrugated strands 3 to bring about like distribution of the openings 4 in both longitudinal and circumferential directions. However, it is more effective to employ the corrugated strands 3 than to employ the parallel strands from the fact that the configuration including the corrugated strands 3 will bring about a greater number of the openings and therefore has the wall of higher porosity than with the parallel strands.

The strands 3, irrespective of whether being corrugated or parallel, are normally made of the same material as the rest of the tube and preferably made of semi-hard or relatively soft plastic materials that have a higher tensile strength as well as a higher impact value for strengthening purposes of the wall portion of the tube.

In the above embodiments, the provision that the circumferentially spaced apart strands 3 construct a single wall of the tube is disclosed, however, it is also effective to provide constructions of more than one wall wherein each strand in one wall is arranged in staggered relationship with respect to the strand in other walls so as to define the openings 4 among the radially and circumferentially adjacent disposed strands.

In the lower circumferential half of the tube, there are provided a plastic thin film 6 adhered on the inner surface of the tube to cover the roughened inner surface contoured by partially appearing annular bands 1, bars 2 and the strands 3 which are exposed in the mesh portions of the bands 1 and bars 2, so that the water will flow smoothly along this film 6 in the lower portion of the tube without being disturbed by such roughened inner surface.

In accordance with the present invention as disclosed in the foregoing embodiments, the longitudinal strands 3 and bars 2 blend into or joined integrally respectively the annular bands 1 in such a way as to accomplish an unique configuration that a plurality of the longitudinal strands 3 having less thicknesses are circumferentially disposed in close relationship with each other to form a wall with the openings 4 defined between the adjacent strands 3 and that thus formed wall is integrally supported or reinforced by the lattice construction defined by the annular bands 1 and the longitudinal bars 2 both having greater thicknesses than those of the strands 3. Accordingly, the tube of this configuration, in addition to having a higher porosity due to the formation of the openings 4 between the adjacently disposed strands 3, is capable of exhibiting against the external pressures an improved strength as high as the prior plastic thick-wall tube having the same thickness as that of the annular bands 1. This enables the plastic tube of the present invention to be manufactured at lower consumption of plastic material and therefore at lower costs. The above reinforcing effect will be further improved by adopting the annular bands 1 having an ellipse-shaped cross section with its major axis extending rather radially. Further, for the tube with sinuously corrugated longitudinal strands 3, the openings 4 are formed between the valley portions of the adjacently disposed strands 3 so that the water in the surrounding soil will be collected in the valley portions and is then smoothly drawn through such openings 4 into the tube, which will assure higher drainage capacity. Also, with this construction of the tube, the valley portions extending circumferentially have along their peripheries some regions in which the adjacent strands are closely packed to form a integrally joined bunch, so that the wall made of a plurality of the circumferentially disposed strands 3 of thin elements is strengthened at its valley portions, which would otherwise be weaker against bending forces, therefore the whole tube is to be reinforced, in addition to the longitudinal bars 2 of thick elements making a lattice construction with the annular bands 1, in such a way as to impart to the resulting tube higher strength against the external pressures acting on the tube from the surrounding soil.

Figure 4:
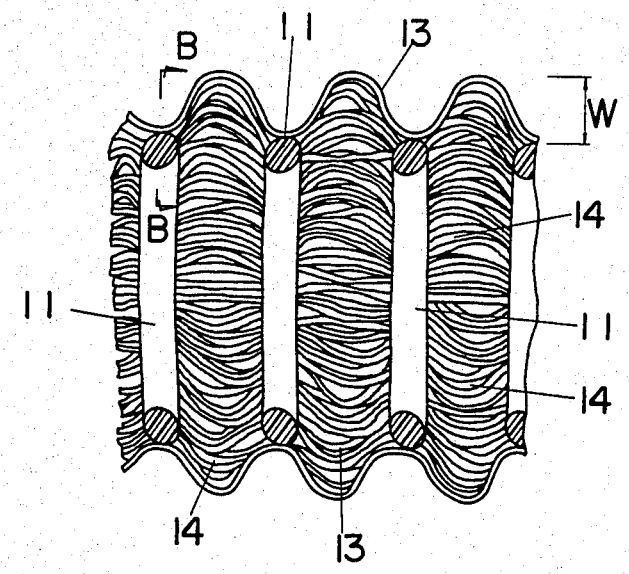
FIG 4 is a longitudinal section of another embodiment of the present invention.
Figure 5:
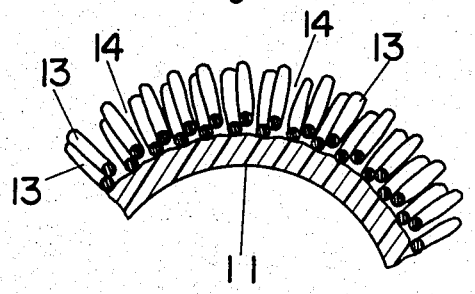
FIG. 5 is a transverse section taken along the line B—B in FIG. 4.
Figure 6:
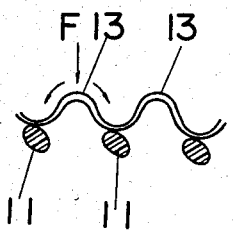
FIG. 6 is a schematic illustration showing how the loads acting on the ridge portions of the tube shown in FIG. 4 are spreaded and supported by the annular bands of greater thicknesses.

Referring now to FIGS. 4, 5 and 6, there is shown a second embodiment of a plastic underdrainage tube in accordance with the present invention which comprises a plurality of axially spaced apart annular bands 11 having relatively greater thicknesses and a plurality of circumferentially disposed longitudinal strands 13 in thicknesses less than those of the annular bands 11. This tube also includes a plurality of circumferentially disposed longitudinal bars having the same thicknesses as the strands 13. There is no distinguishable configuration between the bars and the strands except for their behavior in the extruding process that the annular bands 11 are periodically extruded with being continuous with the bars while the strands 13 are extruded from the ports other than those for the bars and bands to overlap the annular bands 11 immediately after being extruded, so that in the foregoing description as well as in the drawings the bars and strands 13 are altogether referred to as the strands 13. These bands 11 and strands 13 are extruded to have generally circular cross sections respectively. Each band 11 has a cross sectional area 5 to 30 times that of the longitudinal strands 13, which are extruded in the form of being sinuously corrugated along the full length thereof with maintaining generally parallel relationship with each other. In this embodiment, the tube is so extruded as to form a double-wall construction of inner and outer walls each being made of a plurality of the strands arranged along the circumference of a circle. The strands 13 forming the inner wall intersect with and blend into the outer peripheries of the annular bands 11 at their valley portions, while the strands 13 forming the outer wall blend into the strands 13 of the inner wall and/or the annular bands 11 at their valley portions, thus forming a tube wherein the strands 13 and the bands 11 are integrally joined with each other and leaving drainage openings 14 among the ridge portions of the adjacently disposed strands 13. As best illustrated in FIG. 5, the strands 13 forming the inner wall are circumferentially spaced apart along the annular bands 11 at distances shorter than the diameters of the strands 13. The strands 13 forming the outer wall are also closely spaced apart in the vicinity of the annular bands 11 to constitute such circumferential spacing of the strands 13 that one strand 13 in the inner wall lies between the circumferentially adjacent disposed strands 13 in the outer wall. The strands 13, on the other hand, are spaced apart at their ridge portions at wider distances than at their valley portions such that said openings 14 are formed among the ridge portions of circumferentially and radially adjacent strands 13.

The tube of this configuration is obtained by extruding continuously the strands while at the same time extruding periodically the annular bands from the contacting surfaces of two die members constructed in the same manner as described in the afore-mentioned embodiment. In the extruding process of the tube of this embodiment, the strands are extruded through the pores of same diameters at a higher extruding speed than the drawing speed in such a way as to be staggered or corrugated along the length thereof as well as to be joined at their valley portions to the annular bands just extruded, with the result that each strand thus seized at regular intervals along its length by annular bands will cause no substantial warp or distortion in the directions other than the radial direction to have regularly corrugated configuration wherein each strand of substantially same pitch and amplitude extends longitudinally. In this sense, the annular bands 11 are not only to work as reinforcing ring members of the tube but also to cause each strand to regularly corrugate along the length thereof at the time of extruding to ensure the formation of the openings among the ridge portions of the adjacently disposed strands.

According to the foregoing embodiment, in addition to the tube being regarded to have a wall as thick as the amplitude W of the sinuously corrugated strands 13, the tube of this embodiment exhibits the behavior when burried in the soil that the external pressures or forces F applied from the surrounding soil on the ridge portions of the strands 13 will be, as schematically shown in FIG. 6, spreaded along their sides so as to be received by the annular bands 11 of greater thicknesses. Consequently, there will be no concentration of stress in the ridge portions of the strands 13, assuring a higher strength against the surrounding pressures. Also, as disclosed in the above embodiment, the tube of double-wall type has a unique configuration that the strands 13 are arranged such that one strand in each wall lies between the circumferentially adjacent strands in the radially adjacent disposed wall, so that one strand in one of the walls extends across the gap formed between the ridge portions of the circumferentially adjacent strands in the other wall to reduce the dimension of the opening, which improves the filtering effect of blocking the entrance of smaller gravels or pebbles from the surrounding soil. This arrangement is particularly effective when the gap between the circumferentially adjacent strands in one of the walls is accidentally made much greater than a prescribed dimension on solidification.

Figure 7:
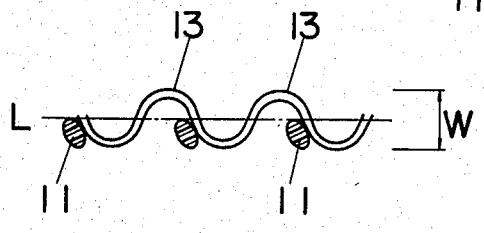
FIG. 7 is a partial schematic sectional view illustrating a modification of the tube shown in FIG. 4.

Within the meaning of the present invention, the valley portions of the corrugated strands are referred to as the portions below the line L bisecting the thickness of the wall, that is, the amplitude W of the corrugation as indicated in FIG. 7, which shows the modification that each corrugated strand 13 join integrally the annular bands 11 at its side portions in juxtaposition with the bottom of the valley.

Further, in accordance with the present embodiment, the size of the opening formed among the ridge portions of the adjacent strands, the thickness of the tube wall (i.e., the amplitude of the corrugated strands) and the strength can be varied by simply controlling the spacing of the annular bands 11, that is, by varying the extruding interval of the annular bands 11 in the longitudinal direction.

In the above embodiment, only the double-wall construction wherein each of inner and outer wall is defined by a plurality of the strands arranged along the circumference of a circle is disclosed, however, the present invention should not be limited to this embodiment and may include the provision of the tube with a single wall or may, of course, include the modification wherein more than two walls are provided for. In multi-wall construction of the strands, the strands may preferably as described hereinbefore be arranged such that one strand in each wall lies between the circumferentially adjacent strands in the radially adjacently disposed wall of the strands. With this arrangement, the above filtering effect of the strands will be increased with the increasing numbers of walls. Still in the above embodiments, only the tubes having the cross section in circular are disclosed, however, the present invention may apply to the tubes having any desired cross section, for example, in triangle, rectangle or semi-circle.

The above description and particulary the drawings are set forth for purposes of illustration only. It will be understood that many variations and modifications of the embodiments herein described will be obvious to those skilled in the art, and may be carried out without departing from the spirit and scope of the invention.

What is claimed is:

1. A plastic underdrainage tube having a longitudinal axis comprising as an integrally extruded unit a plurality of axially spaced apart annulate bands having relatively greater thicknesses arrayed so that said axis passes through a center of each band, a plurality of longitudinally parallel bars each joining integrally at its intersections to said annulate bands to form a reticular tube body, and a plurality of circumferentially disposed longitudinal strands in thicknesses less than those of said annulate bands and those of said bars, said strands joining integrally substantial portions of outer peripheries of said annulate bands and bars respectively and being positioned radially outwardly of said bars at any cross section perpendicular to said longitudinal axis and being closely spaced apart along the circumference of said tube body to define drainage openings therebetween in the mesh portions defined by the annulate bands and longitudinal bars, and said openings being dispersed over the entire surface of the tube.

2. A plastic underdrainage tube as set forth in claim 1, wherein each of said longitudinal strands is sinuously corrugated in the longitudinal direction and joins integrally at its ridge portions to said annulate bands to define said openings between the valley portions of the adjacently disposed strands, and said longitudinally parallel bars have greater thicknesses than the longitudinal strands.

3. A plastic underdrainage tube as set forth in claim 1, wherein each of said longitudinal strands is sinuously corrugated in the longitudinal direction and join integrally at its valley portions to said annulate bands to define said openings between the ridge portions of the adjacently disposed strands, and said longitudinally parallel bars have substantially the same thicknesses as the longitudinal strands.

* * * * *